US006415553B1

(12) United States Patent
Krayer, Jr. et al.

(10) Patent No.: US 6,415,553 B1
(45) Date of Patent: Jul. 9, 2002

(54) PRIVACY SCREEN FOR WORKSTATIONS

(75) Inventors: Kenneth R. Krayer, Jr.; Mark D. Swets, both of Grand Rapids; Troy A. Wyman, Shelbyville, all of MI (US); Joseph T. Graceffa, Chicago, IL (US); Jon D. Schiff, Saint Joseph, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/215,471

(22) Filed: Dec. 18, 1998

(51) Int. Cl.[7] ..... E04H 3/00

(52) U.S. Cl. ..... 52/36.1; 52/239; 52/65; 52/238.1; 52/220.1; 52/205; 49/128; 49/130; 49/426; 256/12

(58) Field of Search ..... 52/36.1, 239, 220.1, 52/205, 238.1, 65; 49/128, 130, 426; 256/12

(56) References Cited

U.S. PATENT DOCUMENTS 3,861,084 A * 1/1975 Ford ..... 49/427
4,791,757 A * 12/1988 Orlando ..... 49/360
4,998,598 A * 3/1991 Mardian et al. ..... 181/284
5,125,202 A * 6/1992 Kissinger ..... 52/239
5,394,658 A * 3/1995 Schreiner et al. ..... 52/36.1
5,675,946 A * 10/1997 Verbeck et al. ..... 52/205

* cited by examiner

*Primary Examiner*—Carl D. Friedman
*Assistant Examiner*—Christy Green
(74) *Attorney, Agent, or Firm*—Price, Heneveld, Cooper, DeWitt & Litton

(57) ABSTRACT

A privacy screen assembly for work spaces of the type having spaced-apart partition panels forming an opening for user ingress and egress therethrough. The privacy screen assembly includes a privacy screen defining a lower edge, and at least one roller mounted adjacent the lower edge for movably supporting the privacy screen on a trackless floor surface. An attachment member is configured to movably interconnect the privacy screen with a first partition panel. The attachment member positions the privacy screen in an offset position relative to the first partition panel. The privacy screen is movable between an open position wherein the privacy screen is disposed alongside at least a portion of the first partition panel, and a closed position wherein the privacy screen closes off at least a substantial portion of the opening.

7 Claims, 10 Drawing Sheets

PRIVACY SCREEN FOR WORKSTATIONS

BACKGROUND OF THE INVENTION

The present invention relates to a privacy screen for workstations, and in particular to a movable privacy screen that can be quickly and easily connected to any one of a variety of different types of partition panel systems.

Open office plans have been developed to reduce overall officing costs, and generally incorporate large, open floor spaces in buildings that are equipped with modular furniture systems with are readily reconfigurable to accommodate the ever changing needs of a specific user, as well as the divergent requirements of different tenants. One arrangement commonly used for furnishing open plans includes movable partition panels that are detachably interconnected to partition off the open spaces into individual workstations and/or offices. Such partition panels are configured to receive hang-on furniture units, such as work surfaces, overhead cabinets, shelves, etc., and are generally known in the office furniture industry as "systems furniture". Another arrangement for dividing and/or partitioning open plans includes modular furniture arrangements, in which a plurality of differently shaped, freestanding furniture units are positioned in a side-by-side relationship, with upstanding privacy screens attached to at least some of the furniture units to create individual, distinct workstations and/or offices. Both of these types of furniture systems, as well as others have been widely received due largely to their ability to be readily reconfigured and/or moved to a new site, since they are not part of a permanent leasehold improvement.

Workstations formed by such partition panels systems are normally arranged to provide an opening for user ingress and egress. However, the opening necessarily allows noise and visual distraction of the worker, such that the workstation may not provide the desired degree of privacy according to the requirements of the workers.

SUMMARY OF THE INVENTION

One aspect of the present invention is to provide a trackless privacy screen assembly for work spaces of the type having spaced-apart partition panels forming an opening for user ingress and egress therethrough. The privacy screen assembly includes a privacy screen defining a lower edge, and at least one roller mounted adjacent the lower edge for movably supporting the privacy screen on a trackless floor surface. An attachment member is configured to movably interconnect the privacy screen with a first partition panel. The attachment member positions the privacy screen in an offset position relative to the first partition panel. The privacy screen is movable between an open position wherein the privacy screen is disposed alongside at least a portion of the first partition panel, and a closed position wherein the privacy screen closes off at least a substantial portion of the opening.

Another aspect of the present invention is a partition system of the type having spaced-apart partition panels forming opening for user ingress and egress therethrough, the improvement including a trackless privacy screen defining a lower edge. At least one roller is mounted adjacent the lower edge for movably supporting the privacy screen on a trackless floor surface. An attachment member movably interconnects the privacy screen with a first partition panel. The attachment member positions the privacy screen in an offset position relative to the first partition panel. The privacy screen is movable between an open position wherein the privacy screen is disposed alongside at least a portion of the first partition panel, and a closed position wherein the privacy screen closes off at least a substantial portion of the opening.

Yet another aspect of the present invention is a privacy screen assembly for workspaces of the type having spaced-apart partition panels forming an opening for user ingress and egress therethrough. The privacy screen assembly includes a generally upright adapter post, and a privacy screen with upper and lower vertically spaced-apart guides that are slidably interconnected to the upper and lower guides. The adapter post is configured for attachment to a selected one of the partition panels to position the privacy screen in offset position relative to the partition panels. The privacy screen is movable between an open position permitting user ingress and egress, and a closed position wherein the privacy screen closes off at least a substantial portion of the opening.

Yet another aspect of the invention is a kit for interconnecting a movable privacy screen to various types of partition systems having different constructions, wherein the partition systems are of the type that form work spaces having an opening for user ingress and egress therethrough. The kit includes a vertical post and a privacy screen slidably connected to the vertical post. The kit further includes at least two connection brackets, a first connection bracket permitting attachment of the vertical post to a first partition system having a first construction, and a second connection bracket having configuration permitting attachment of the vertical post to a second partition system having a second construction.

These and other features, advantages and objects of the present invention will be further understood and appreciated by those skilled in the art by reference to the following specification, claims and appended drawings.

BRIEF DESCRIPTION OF THE DRAWINGS

FIG. 1.

FIG. 3.

FIG. 5.

FIG. 2.

DETAILED DESCRIPTION OF PREFERRED EMBODIMENTS

Figure 1:
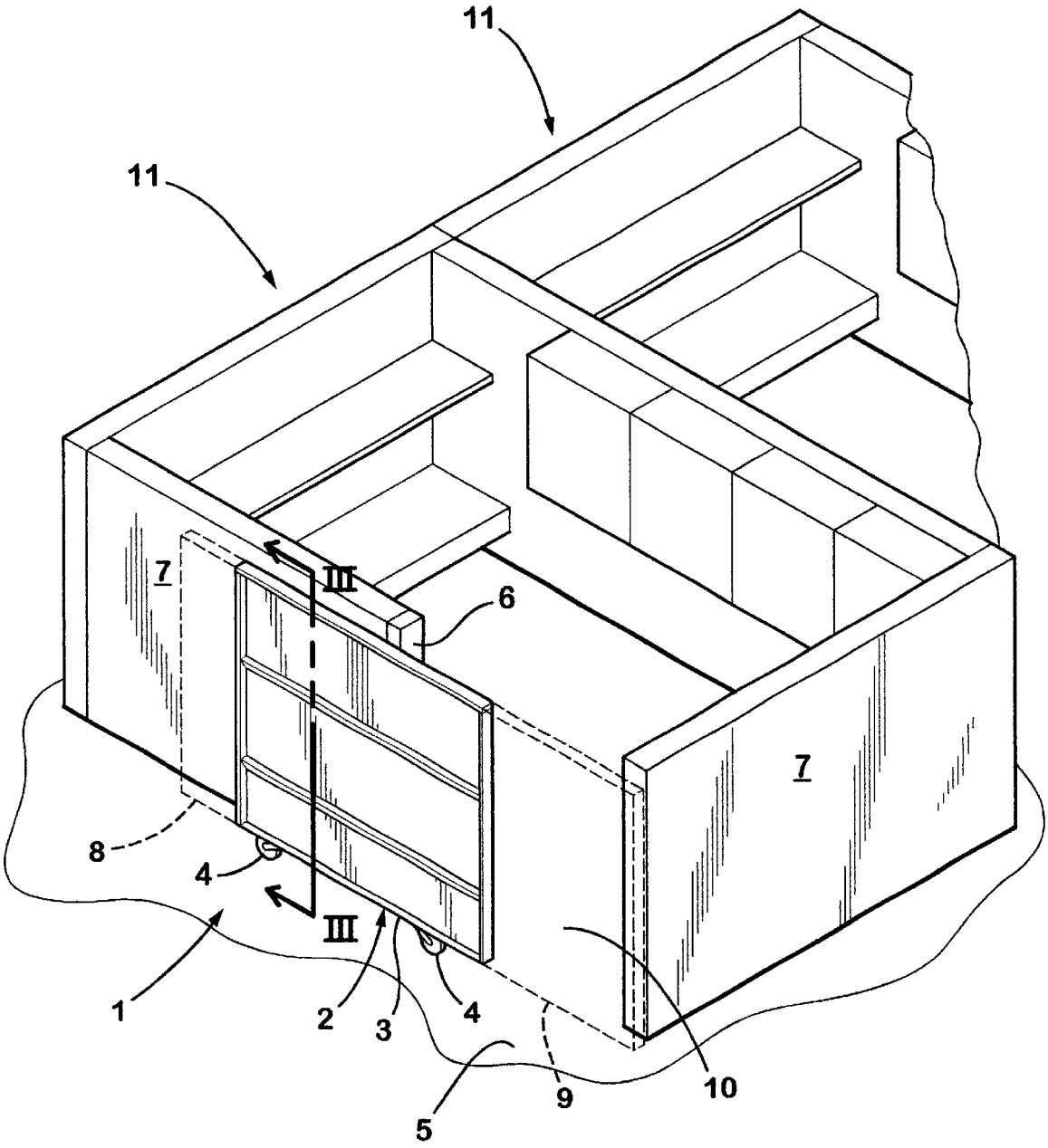
FIG. 1 is fragmentary, perspective view of a workstation and privacy screen assembly embodying the present invention.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a privacy screen assembly 1 embodying the present invention, which is particularly designed for use in open office plans, and other similar settings and environments. The trackless privacy screen assembly 1 is adapted for use with workspaces 11 of the type having spaced-apart panels 7 forming an opening 10 for user ingress and egress therethrough. In the illustrated example, the privacy screen assembly 1 includes a privacy screen 2 defining a lower edge 3. At least one roller such as a wheel 4 is mounted adjacent the lower edge 3 for movably supporting the privacy screen on a trackless floor surface 5. An attachment member such as a post 6 is configured to movably interconnect the privacy screen 2 with a first partition panel 7. The post 6 positions the privacy screen 2 in an offset position relative to the first partition panel 7, and the privacy screen 2 is movable between an open position 8 wherein the privacy screen 2 is disposed alongside at least a portion of the first partition panel 7, and a closed position 9 wherein the privacy screen 2 closes off at least a substantial portion of the opening 10 of the work space 11.

Figure 2:
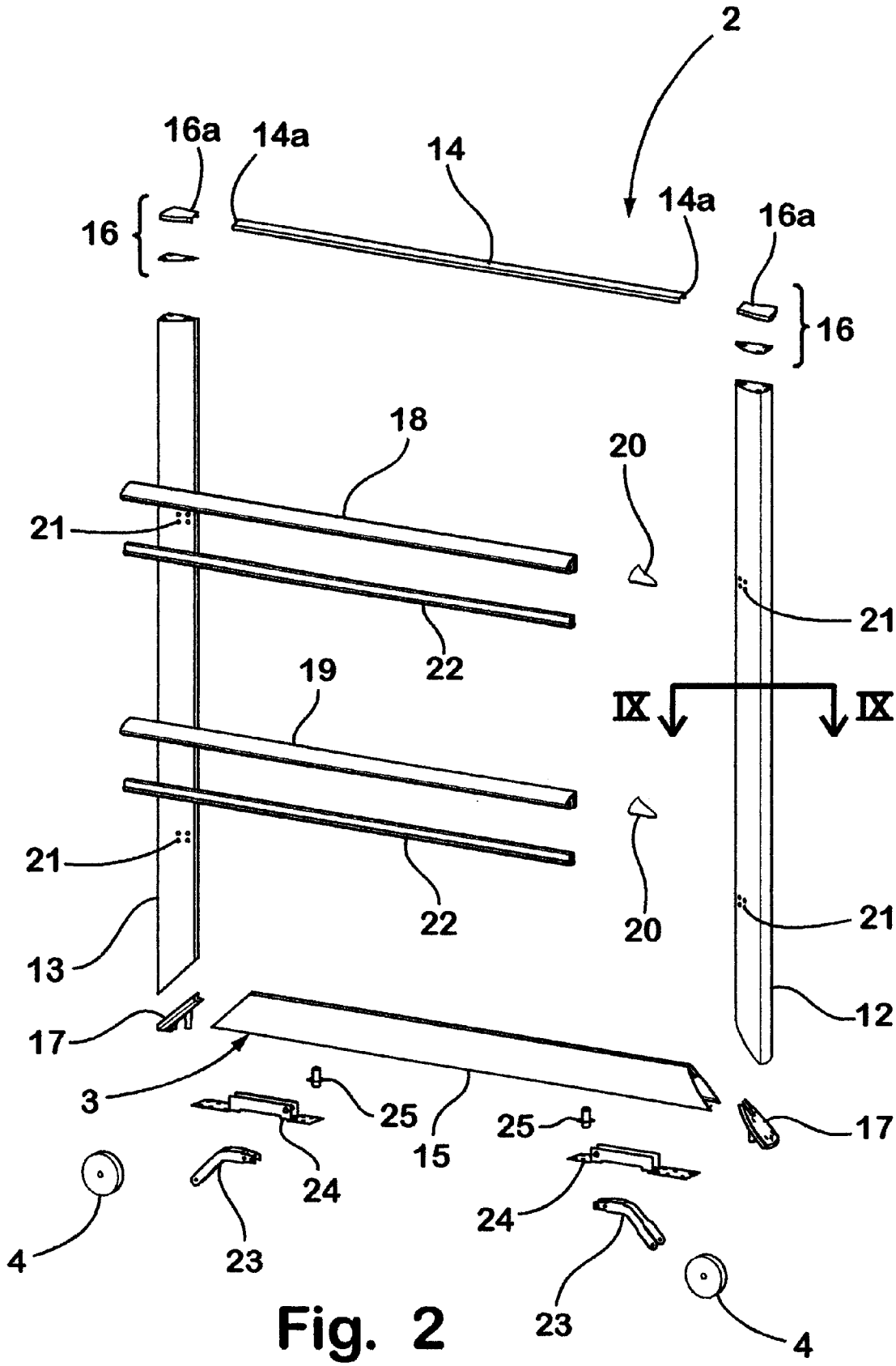
FIG. 2 is an exploded perspective view of the privacy screen.

With further reference to FIG. 2, the privacy screen 2 includes vertical frame members 12 and 13, and upper and lower frame members 14 and 15, respectively. The frame members are extruded aluminum or other suitable material. Upper frame member 14 is rigidly connected to the vertical frame members 12 and 13 by upper corner pieces 16 that are molded polymer or other conventional construction. Lower frame member 15 is connected to the vertical frame members 12 and 13 by lower corner pieces 17. Upper rail 18 and lower rail 19 are also extruded aluminum, and extend between vertical frame members 12 and 13. Rail brackets 20 and conventional fasteners such as self-tapping screws (not shown) secure the rails 18 and 19 to openings 21 in vertical frame members 12 and 13. As described in more detail below, an elongated a low friction wear strip 22 fits within each of the rails 18 and 19, and slidably interconnects the privacy screen 2 to the post 6 to guide and position screen 2 during opening and closing of screen 2. As also described in more detail below, wheel arms 23, wheel mounting brackets 24, and fasteners 25 adjustably mount the wheels 4 to the lower frame member 15, and provide height adjustment to properly position privacy screen 2 relative to the partition panels 7 of the work space 11.

Figure 3:
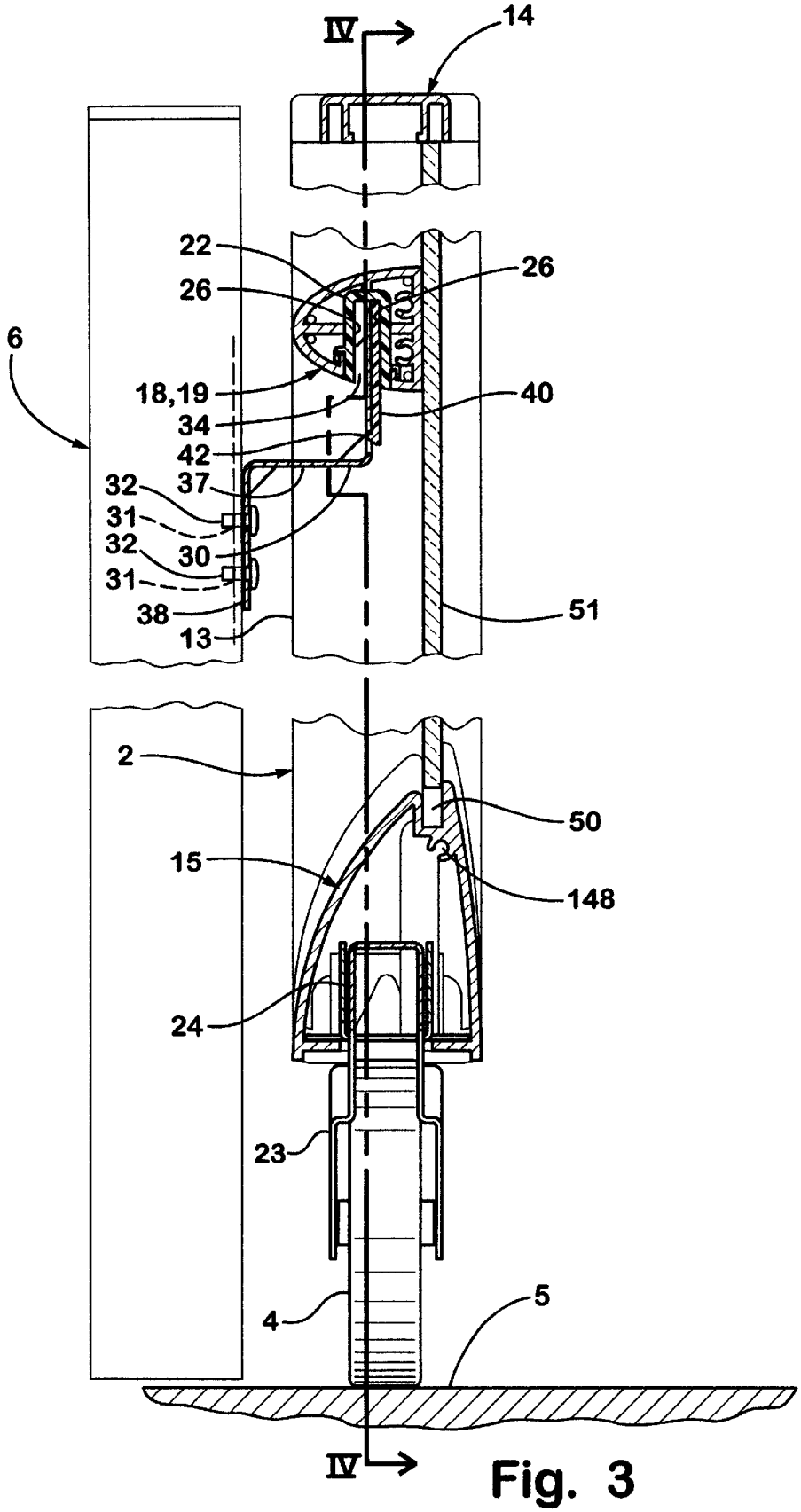
FIG. 3 is a fragmentary, cross-sectional view of the privacy screen taken along the line III—III.
Figure 9:
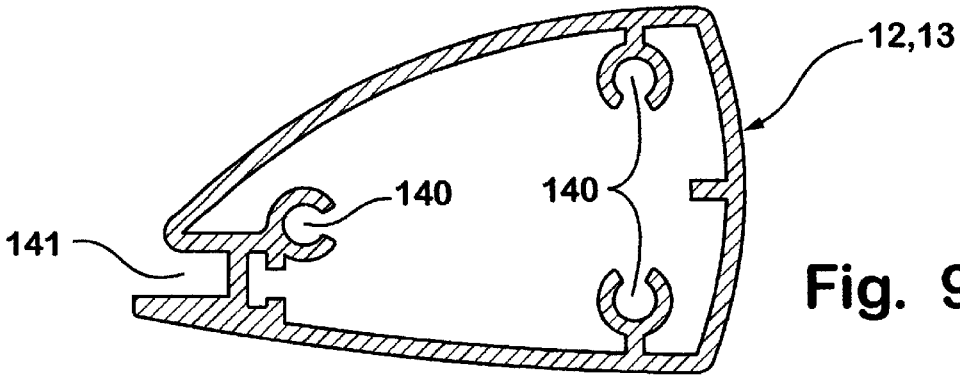
FIG. 9 is a cross-sectional view of the vertical side member of the privacy screen taken along the line IX—IX.
Figure 10:
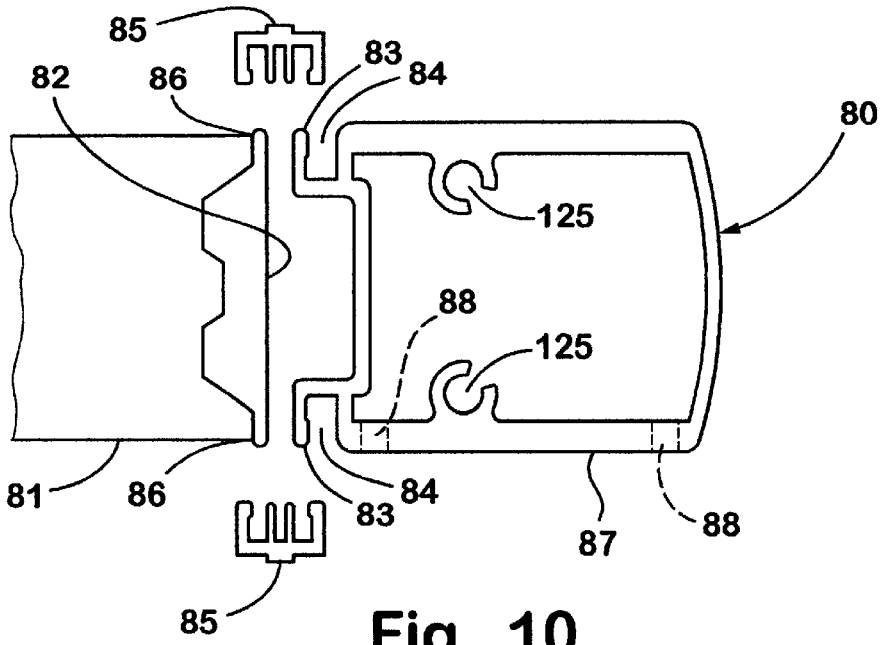
FIG. 10 is a fragmentary, partially schematic, exploded top plan view of the post showing the post connected to a Steelcase Series 9000® partition panel.
Figure 20:
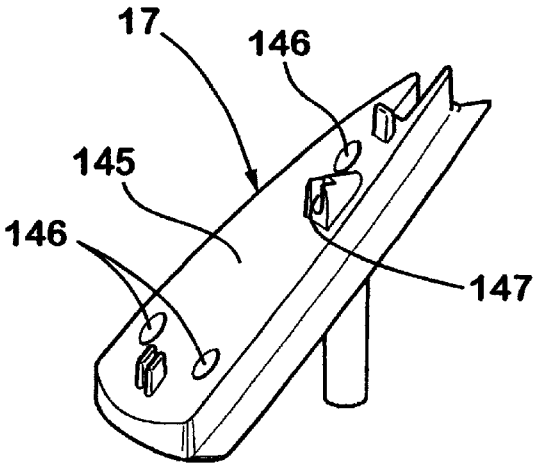
FIG. 20 is a perspective view of the corner piece of FIG. 2.
Figure 21:
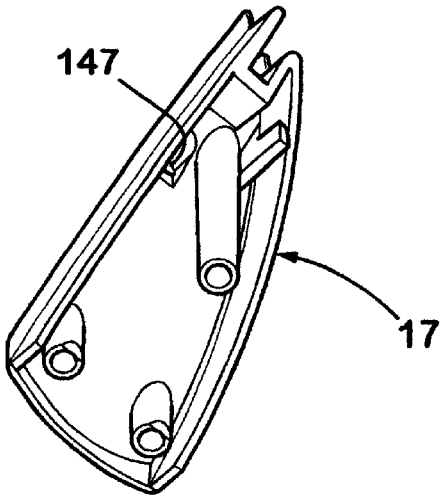
FIG. 21 is a perspective view of the corner piece of FIG. 20.

As illustrated in FIG. 9, vertical frame members 12 and 13 include three screw bosses 140, and an inwardly facing U-channel 141 that receives a side edge of a sheet 51 (FIG. 3). Lower frame member 15 has an upwardly-opening channel 50 that receives a lower edge of a sheet 51. Sheet 51 may be clear, frosted, translucent or opaque polymer, or other suitable material such as hardboard or sound-absorbing material. With further reference to FIGS. 20 and 21, lower corner pieces 17 are made of a suitable polymer material, and include three openings 146 in web 145 that correspond to the screw bosses 140 in frame members 12 and 13. A fourth opening 147 is transverse to openings 146, and receives a standard screw (not shown) that is received in a screw boss 148 (FIG. 3) of the lower frame member 15. Comer piece 17 illustrated in FIGS. 20 and 21 is used at the lower right corner of the screen 2 (FIG. 2), and the corner piece at the lower left is a mirror image of the corner piece illustrated in FIGS. 20–21. Upper corner pieces 16 (FIG. 2) are secured to screw bosses 140 of frame members 12 and 13, and include extensions **16*a* that are received within the ends 14*a* of frame member 14**.

Figure 4:
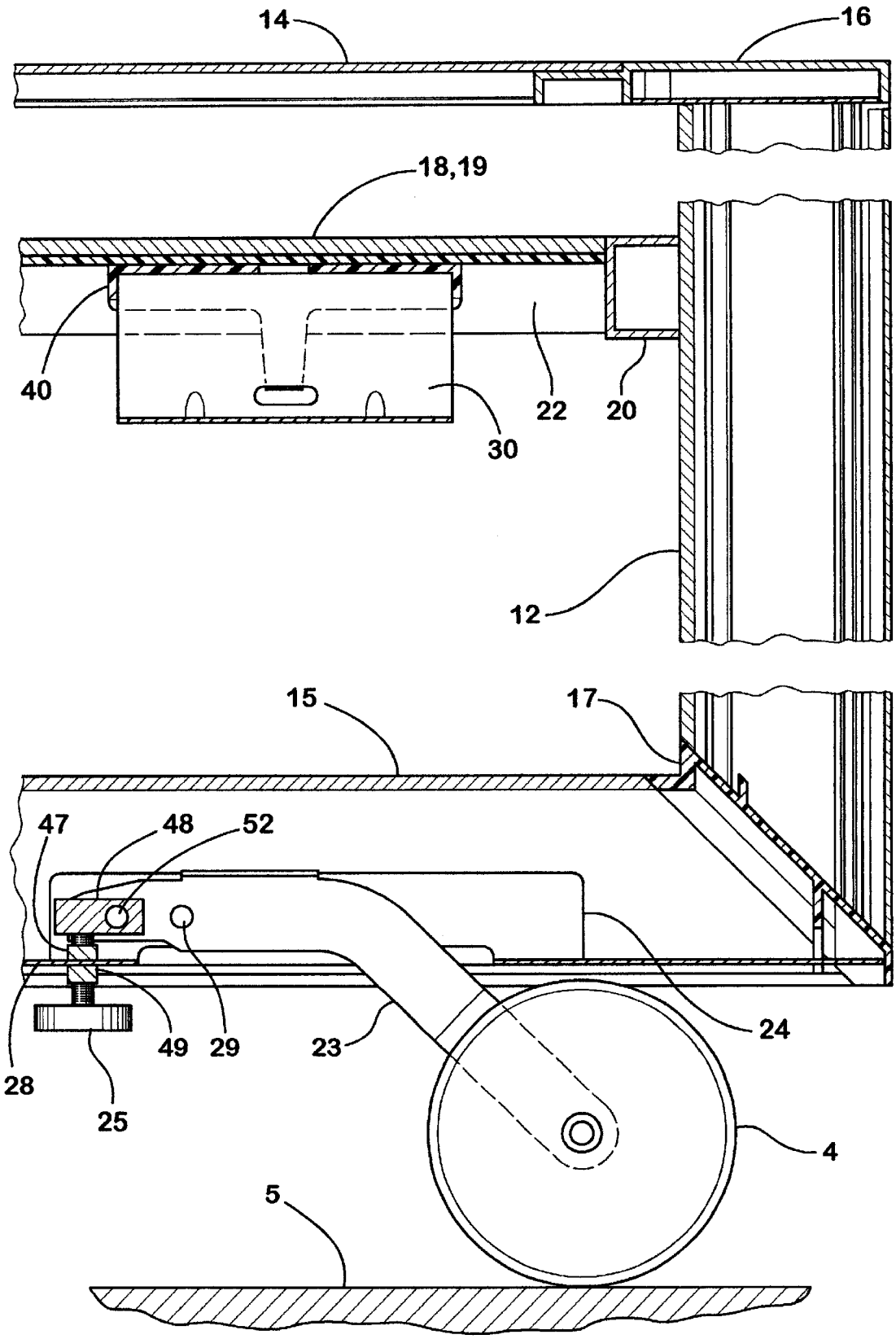
FIG. 4 is a fragmentary, cross-sectional view of the privacy screen take along the line IV—IV.
Figure 5:
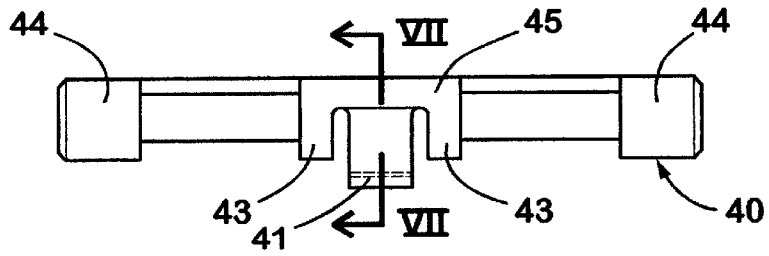
FIG. 5 is a front elevational view of a pillow block that slidably connects the privacy screen to a partition panel.
Figure 7:
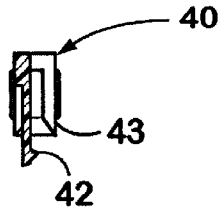
FIG. 7 is a cross-sectional view of the pillow block taken along the line VII—VII.
Figure 6:
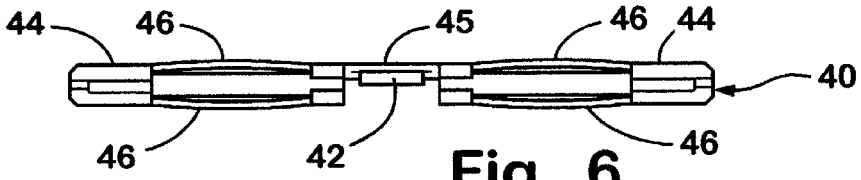
FIG. 6 is a bottom elevational view of the pillow block.
Figure 8:
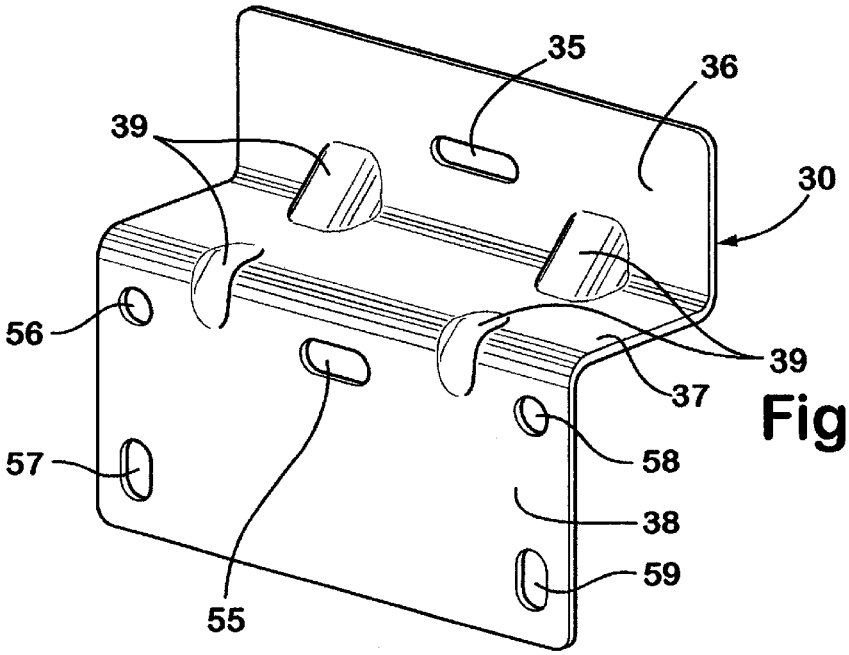
FIG. 8 is a perspective view of a pillow block bracket that secures the pillow block to the privacy screen.
Figure 22:
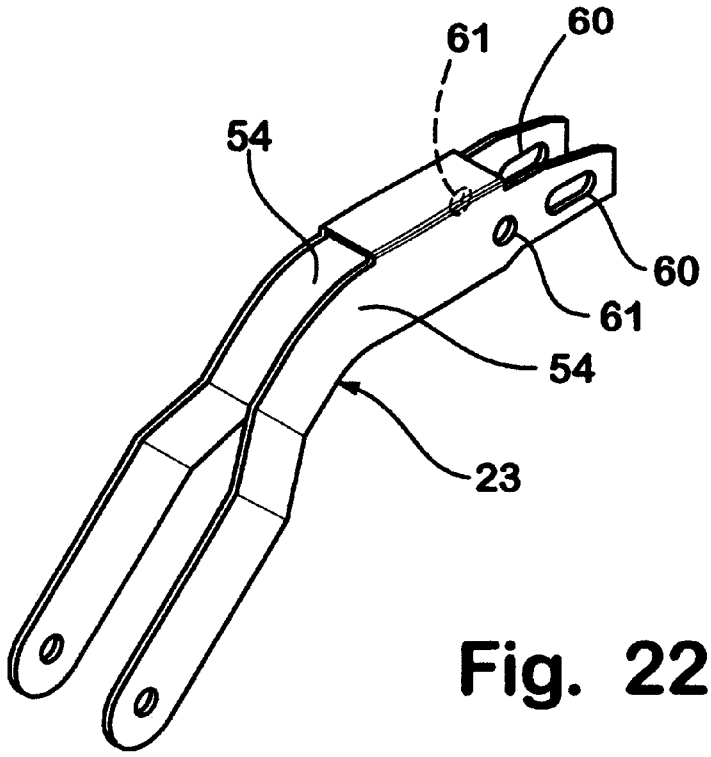
FIG. 22 is a perspective view of the wheel arm of FIG. 2.
Figure 23:
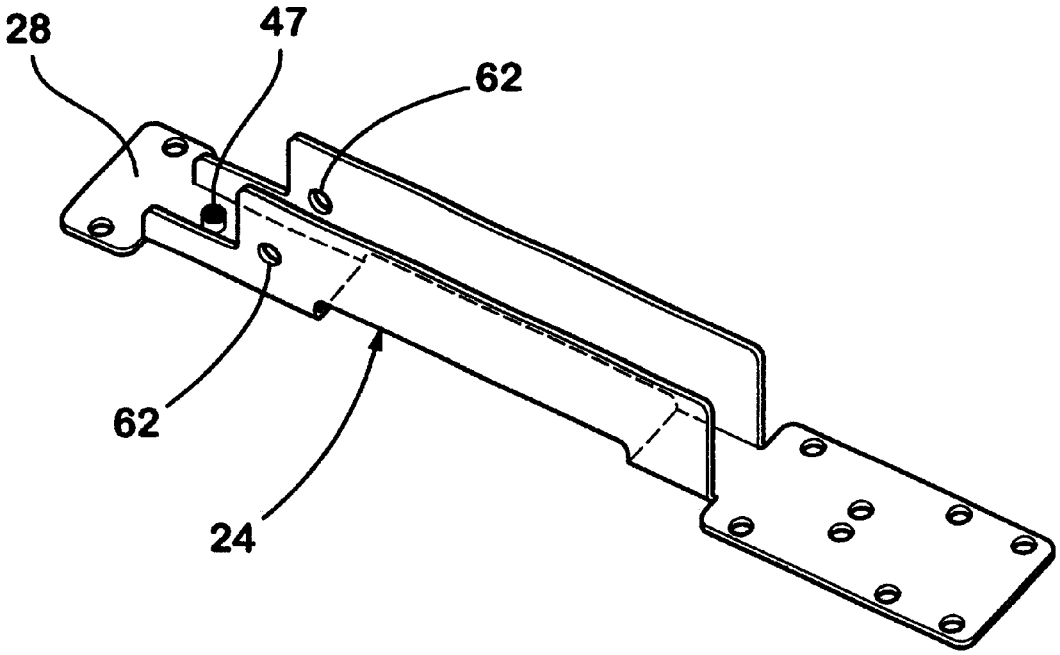
FIG. 23 is a fragmentary, perspective view of the wheel mounting bracket of FIG. 2.

With reference to FIG. 4, the screen height adjustment assembly includes a threaded member such as bolt 25 that extends through bushings 47 that are fixed to lower wall 28 of wheel mounting bracket 24 (see also FIGS. 22 and 23). Wheel arm 23 is pivotally mounted to wheel mounting bracket 24 by a pin 29 that extends through openings 61 in wheel arm 23, and openings 62 in wheel bracket 24. Adjustment block 48 is pivotably interconnected with wheel arm 23 by a pin 52 that is received in elongate slots 60 in sidewalls 54 of wheel arm 23. Bolt 25 threadably engages threaded opening 53 in block 48, and shoulder 49 of bolt 25 bears against the upper end of bushing 47, thereby preventing rotation of wheel arm 23 about pin 29. The screen height can be adjusted by turning bolt 25, thereby raising or lowering block 48 and rotating wheel arm 23 about pin 29. During adjustment, pin 52 slides within slots 60 of wheel arm 23 to permit rotation of wheel arm 23. The height of the screen can be adjusted in this manner to account for variations in the contour of floor surface 5, and thereby support the screen 2 at the correct position relative to post 6 and partition panels 7.

A pillow bracket 30 (FIG. 3) is secured to the outer face 3 of the post 6 by conventional fasteners such as self-tapping screws 32 that are received within openings 31 in post 6. Wear strip 22 is made of extruded acetal resin (polyoxymethylene thermoplastic polymer), or other suitable low-friction material. Wear strip 22 has a generally U-shaped cross section, and forms a downwardly opening U-channel 34. As described in more detail below, a slide/pillow block 40 is connected to pillow bracket 30, and is slidably received within U-channel 34, thereby slidably interconnecting the privacy screen 2 with the post 6. Rigid horizontal members such as upper and lower rails 18 and 19 each guide and slidably connect to the post 6 by means of substantially identical wear strips, pillow blocks, and pillow bracket arrangements.

Figure 12:
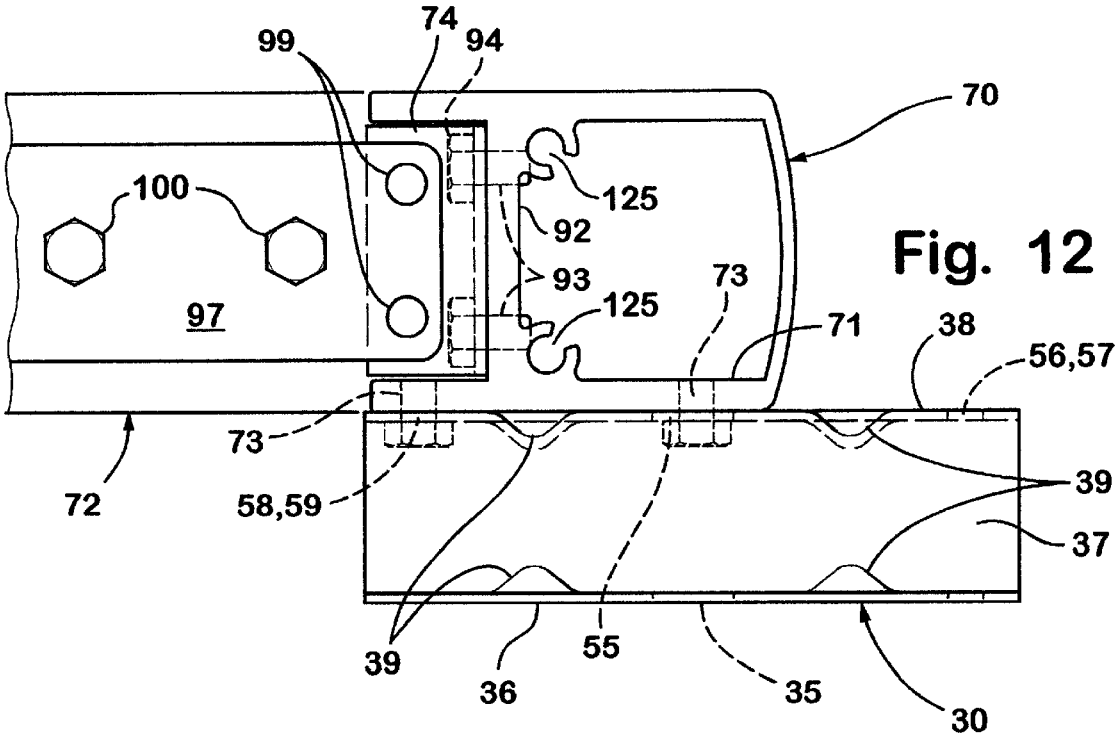
FIG. 12 is a fragmentary, partially schematic, top plan view of anther embodiment of the post and bracket connected to a Steelcase PATHWAYS partition panel having a two-inch thickness.

With further reference to FIGS. 5–8, pillow block 40 is molded from acetal resin and includes a downwardly-extending center tab 41 with a barb or protrusion 42 that is received within slot 35 of web 36 of pillow bracket 30. Center tab 41, and outer tabs 43 secure the pillow block 40 to the pillow bracket 30. Pillow block 40 includes end portions 44, and a central portion 45. Thin wall portions 46 extend between end portions 44 and central portion 45, and curve outwardly slightly and contact the inner side walls 26 of wear strip 22 when pillow block 40 is received within U-channel 34. The wall portions 46 are flexible to provide a secure, slidable interconnection between pillow block 40 and wear strip 22, without causing excessive friction. This arrangement simultaneously eliminates looseness associated with excessive clearance between the moving parts. Pillow bracket 30 includes a horizontal web 37 and a vertical, lower web 38 with deformed gusset portions 39 at the corners for rigidity. Web 38 has a center slotted opening 55, and first upper and lower openings 56, 57, respectively, as well as second upper and lower openings 58, 59, respectively. With further reference to FIG. 12, pillow bracket 30 may be mounted to a post in either a left hand or right hand configuration. As described in more detail below, second openings 58 and 59, and the center opening 55 may be used to secure the pillow bracket 32 to side wall 71 of a post 70 as shown in FIG. 12. As described in more detail below, post 70 is configured to mount to a two inch wide Steelcase PATHWAYS partition panel 72. Partition panel 72 is substantially the same as the "thin" panel arrangement disclosed in detail in pending U.S. patent application Ser. No. 08/892,010, entitled "PANEL-TO-PANEL CONNECTORS FOR OFFICE PARTITIONS", filed Jul. 14, 1997, the entire contents of which are hereby incorporated by reference. If required for a particular application, post 70 can be mounted to the opposite or "right hand" side of the opening 10 of the work space 11 in a mirror image of the "left hand" configuration illustrated in FIGS. 1 and 12. In the right hand configuration, first openings 56 and 57, as well as center opening 55 are used to secure the pillow bracket to the post 70. As also described in more detail below, when post 70 is secured to the opposite side of opening 10 of work space 11, post 70 is inverted, and additional mounting holes that are positioned at the correct height for the inverted configuration are utilized.

FIGS. 10–13 illustrate various post configurations that permit connection of the privacy screen 2 to different types of existing partition panel systems. Each of the posts is extruded aluminum or other suitable material. Post 80 (FIG. 10) is configured to permit connection to an end 82 of a standard Steelcase Series 9000 partition panel 81. Post 80 includes outwardly-extending flanges 83 that define channels 84. A standard Steelcase Series 9000 connector strip 85 is received within channel 84, and fits over the standard end portion 86 of the Series 9000 panel 81 to secure the post 80 to the panel 81. A plurality of openings 88 in sidewall 87 of post 80 receive self-tapping screws or other standard fasteners to secure a pillow bracket 30 to the post 80. The locations of openings 88 are chosen to position the pillow brackets 30 and pillow blocks 40 at heights corresponding to upper and lower rails 18 and 19.

Figure 11:
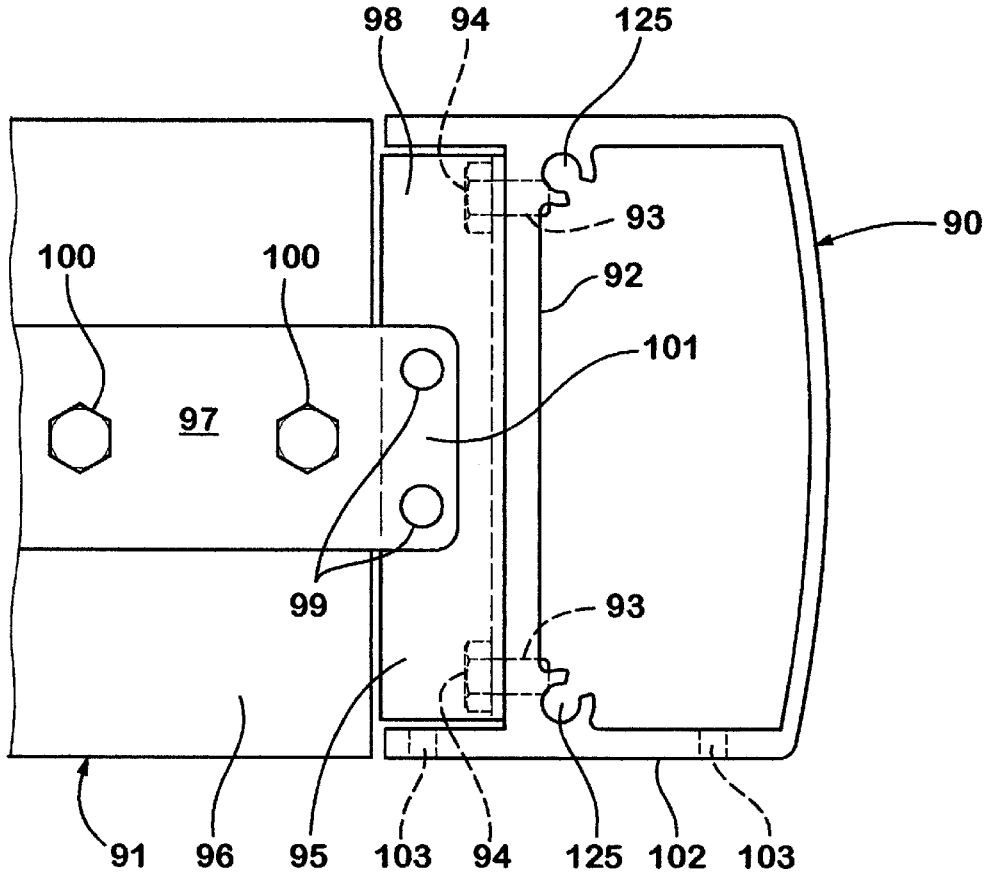
FIG. 11 is a fragmentary, partially schematic, top plan view showing another embodiment of the post and bracket connected to a Steelcase PATHWAYS partition wall having a four-inch wall thickness.

As illustrated in FIG. 11, a post 90 is configured to be connected to a standard Steelcase four-inch wide PATHWAYS partition panel 91 that has substantially the same construction as the "thick" partition panel described in detail in the above-identified pending U.S. patent application Ser. No. 08/892,010, entitled "PANEL-TO-PANEL CONNECTORS FOR OFFICE PARTITIONS". Side wall 92 of post 90 includes a plurality of openings 93 that receive self-tapping screws or other fasteners 94 to secure upper and lower L-brackets 95 to the post 90 at heights corresponding to upper and lower horizontal frame member 96 of panel 91. A standard strap or "frame bracket" 97 is secured to the horizontal frame member 96 by means of fasteners 100, or other suitable arrangement. Frame bracket 97 is substantially the same as the frame bracket arrangement described in detail in the above-identified pending U.S. patent application Ser. No. 08/892,010, entitled "PANEL-TO-PANEL CONNECTORS FOR OFFICE PARTITIONS". The end portion 101 of frame bracket 97 overlaps the horizontal leg 98 of L-bracket 95, and bolts or other fasteners (not shown) extend through the clearance holes 99 in frame bracket 97 and horizontal leg 98 to secure the post 90 to the partition 91. A plurality of L-brackets 95 are positioned on post 90 at heights corresponding to the horizontal frame members 96. Side wall 102 of post 90 includes openings 103 that secure a pillow bracket 30 and pillow block 40 at heights corresponding to the upper and lower rails 18 and 19. Post 70 (FIG. 12) connects to a standard Steelcase 2-inch wide PATHWAYS partition panel 72 using standard frame brackets 97 in substantially the same manner as described above with respect to the post 90. Post 70 also includes substantially the same pillow bracket mounting arrangement as described for post 90.

Figure 13:
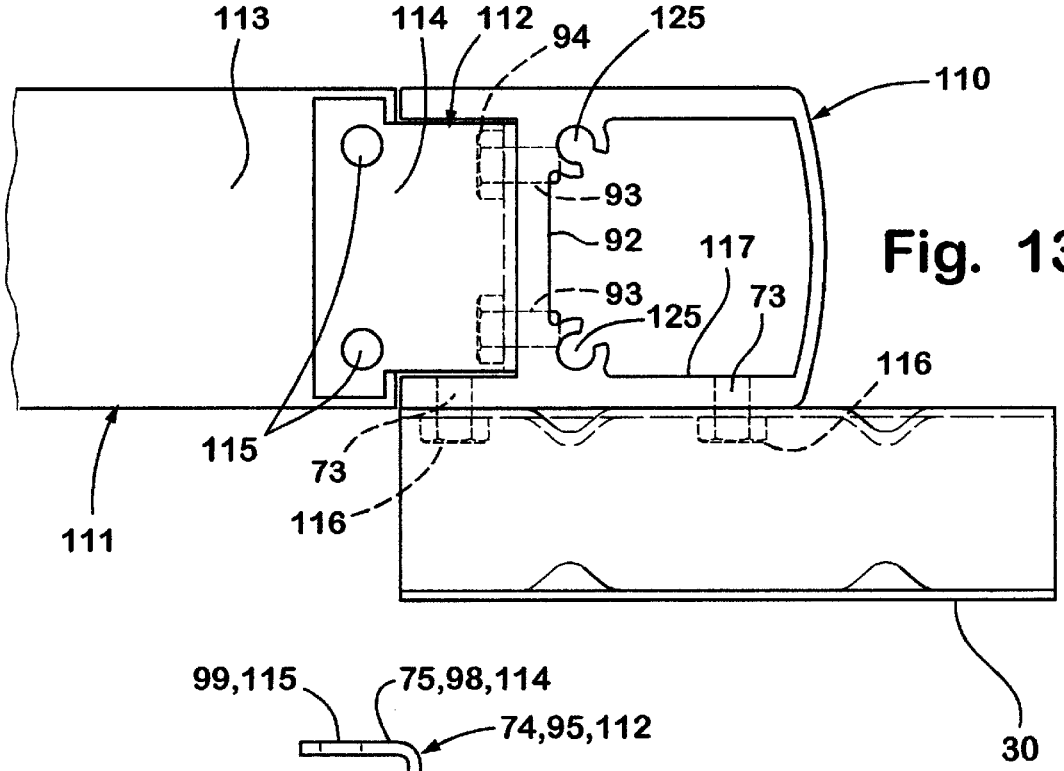
FIG. 13 is a fragmentary, partially schematic, top plan view of another embodiment of the post and bracket connected to a Steelcase Avenir® partition panel.

With reference to FIG. 13, post 110 is configured to secure the privacy screen to a standard Steelcase AVENIR partition panel 111. AVENIR post 110 is substantially similar to post 70, except that holes 93 are positioned at heights corresponding to upper and lower horizontal frame members 113 of a Steelcase AVENIR partition panel 111. Partition panel 111 includes a pair of threaded openings on the upper panel edge and the lower panel edge that can be used to interconnect a pair of partition panels 111 by means of standard AVENIR panel-to-panel connectors. L-bracket 112 is similar to L-brackets 74 and 95, except that horizontal leg 114 and clearance openings 115 are configured to interconnect with the horizontal frame member 113 of the AVENIR partition panel 111. Self-tapping or other suitable fasteners 116 secure the pillow bracket 30 to the holes 73 in sidewall 117 of post 110 in substantially the same manner as posts 70, 80, and 90.

Figure 14:
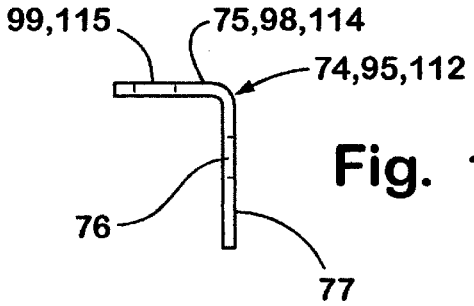
FIG. 14 is a side elevational view of the L-brackets of FIGS. 11–13.

Each of the L-brackets 74, 95, and 112 has an L-shaped cross section substantially as illustrated in FIG. 14. However, the horizontal leg 75, 98 or 114 of each L-bracket has a configuration as illustrated in FIGS. 11, 12, and 13, respectively, as required to connect to one of the standard partition panel systems described above. Openings 76 in vertical leg 77 correspond to the openings 93 in posts 70, 90, 110, and receive conventional self-tapping screws or other suitable fasteners to secure the L-bracket to the post.

Figure 15:
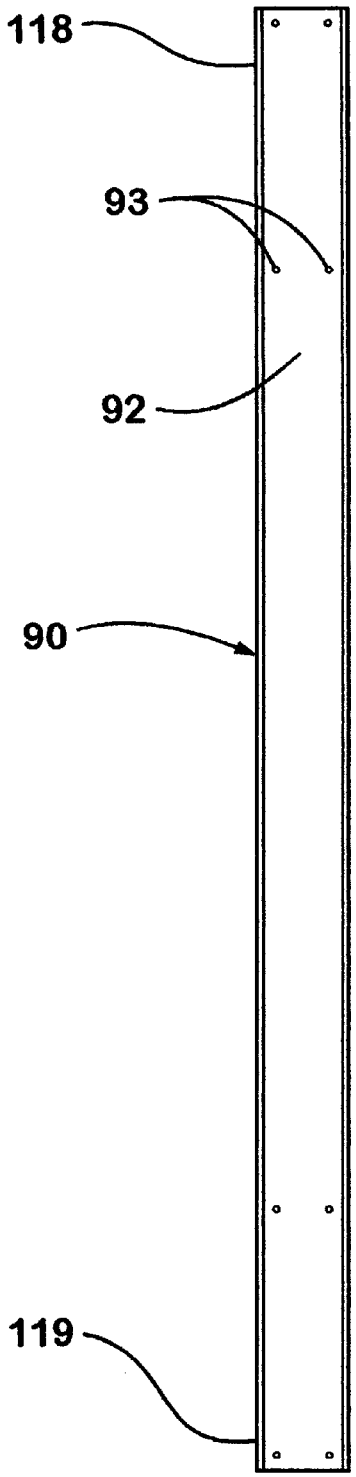
FIG. 15 is a top elevational view of the post of FIG. 11.
Figure 16:
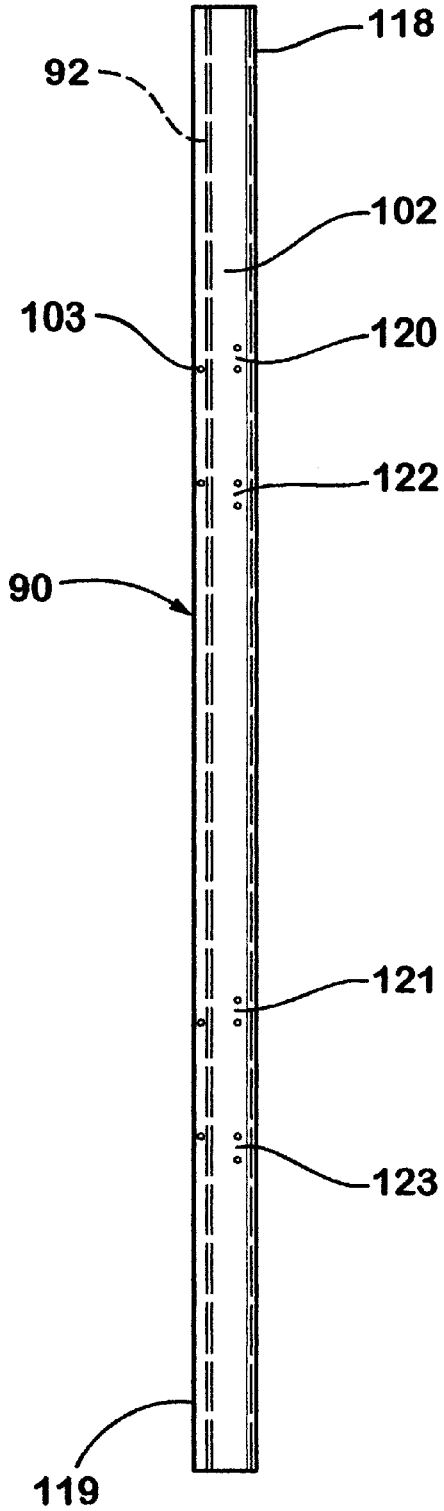
FIG. 16 is a front elevational view of the post of FIG. 11.

With further reference to FIGS. 15 and 16, each of the posts 70, 80, 90, and 110 include a plurality of openings in a side wall for mounting the pillow bracket 30 as described above. Each of the posts 70, 80, 90 and 110 can be used on either side of an opening 10 of the work space 11 by inverting the post to a configuration that is a mirror image of the "left hand" configuration illustrated in FIGS. 10–13. For example, post 90 includes a plurality of openings 103 in sidewall 102 for connecting pillow bracket 30. When post 90 is oriented as illustrated FIG. 11, first end 118 of post 90 will be positioned adjacent the floor, and first and second sets of openings 120 and 121 are used to secure pillow brackets 30 to posts 90. However, if post 90 is used on the opposite, or "right hand" side of an opening 10 of a work space 11 in a mirror image of the configuration illustrated in FIG. 11, second end 119 of post 90 will be positioned adjacent the ground, and third and fourth sets of openings 122 and 123 will be used to secure a pair of pillow brackets to the post 90. Posts 70, 80, and 110 each include four sets of openings for securing a pair of pillow brackets 30 in substantially the same manner described above with respect to post 90. Furthermore, as also discussed above, posts 70, 90, and 110 each include a four sets of openings 93 for mounting an L-bracket 74, 95, or 112 at a height corresponding to the horizontal cross-members of the particular partition panel system the screen assembly 1 is being connected to. Four sets of openings 93 are provided to permit the post 70, 90, or 110 to be inverted, while still permitting the L-brackets to be connected to the posts at heights corresponding to the horizontal frame members of the partition system.

Figure 17:
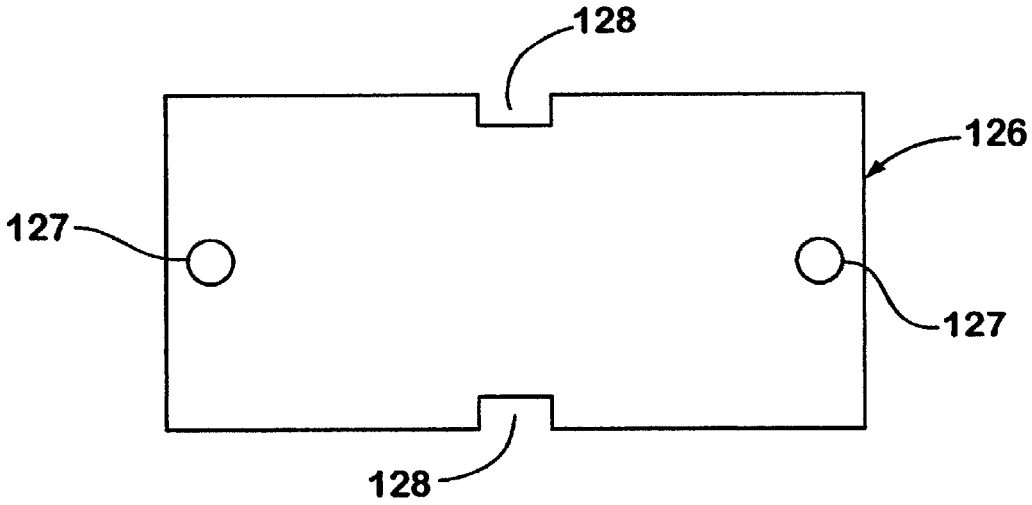
FIG. 17 is top plan view of a post plate.
Figure 18:
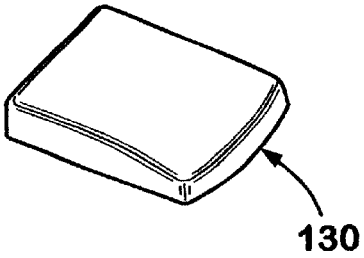
FIG. 18 is a perspective view of a post cap that connects to the post plate of FIG. 17.
Figure 19:
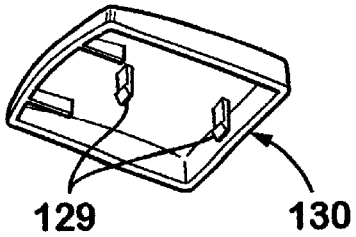
FIG. 19 is a perspective view of the post cap of FIG. 18.

Each of the posts 70, 80, 90, and 110 include a pair of screw bosses 125 extending along the post. Standard fasteners (not shown) pass through the openings 127 of a post plate 126 (FIG. 17) to secure the post plate to the top of the post 70, 80, 90 or 110. Post plate 126 includes notches 128 that receive the barbs 129 (FIG. 19) of a post cap 130 to secure the cap 130 to the post. Post cap 130 is made of a polymer material, and post plate 126 is made of suitable sheet metal stock. Plate 126 and cap 130 may be sized to match each of the post configurations illustrated above.

The privacy screen of the present invention can be readily connected to a variety of existing partition panels by means of the post and bracket arrangements described above. Furthermore, the screen can be readily removed, and reinstalled to an opposite side of an opening 10 of a workspace 11 if desired. The weight of the screen 2 is supported by the wheels 4 on the floor surface, such that a large weight-bearing guide structure is not required to support the privacy screen on the partition panel 7.

In the foregoing description, it will be readily appreciated by those skilled in the art that modifications may be made to the invention without departing from the concepts disclosed herein.

The invention claimed is:

1. A trackless privacy screen assembly for workspaces having spaced-apart partition panels forming an opening for user ingress and egress therethrough, said privacy screen comprising:

a privacy screen defining a lower edge;

at least one roller mounted adjacent said lower edge for movably supporting said privacy screen on a trackless floor surface;

a slide bracket having a slide block, said slide bracket configured to movably interconnect said privacy screen with a first partition panel, said slide bracket positioning said privacy screen in an offset position relative to the first partition panel, said privacy screen movable between an open position wherein said privacy screen is disposed alongside at least a portion of the first partition panel, and a closed position wherein said privacy screen closes off at least a substantial portion of the opening;

said privacy screen including a rigid quadrilateral perimeter frame defining a central portion therein, with an intermediate horizontal frame member extending across said central portion; and wherein:

said intermediate horizontal frame member including a downwardly-opening channel slidably receiving therein said slide block of said slide bracket.

2. A privacy screen assembly as set forth in claim 1, wherein:

said privacy screen includes an opaque light-blocking sheet extending over a central portion of said screen.

3. A privacy screen assembly as set forth in claim 2, wherein:

said light-blocking sheet is made of a polymer material.

4. A privacy screen assembly as set forth in claim 1, wherein:

said roller is configured to directly contact a substantially continuous floor surface.

5. A privacy screen assembly as set forth in claim 1, wherein:

said roller is adjustably mounted to said privacy screen and provides height adjustment and vertically positions said privacy screen.

6. A privacy screen assembly as set forth in claim 1, including:

a post having vertical channels extending along opposite front faces, said channels shaped to accommodate connector strips to secure said post to a vertical side edge of a partition panel.

7. A trackless privacy screen assembly for workspaces having spaced-apart partition panels forming an opening for user ingress and egress therethrough, said privacy screen comprising:

a privacy screen defining a lower edge;

at least one roller mounted adjacent said lower edge for movably supporting said privacy screen on a trackless floor surface;

an attachment member configured to movably interconnect said privacy screen with a first partition panel, said attachment member positioning said privacy screen in an offset position relative to the first partition panel, said privacy screen movable between an open position wherein said privacy screen is positioned wholly outside the first partition panel and disposed alongside at least a portion of the first partition panel in an overlapping relationship therewith, and a closed position wherein said privacy screen closes off at least a substantial portion of the opening;

a post defining a vertically-extending side face; and a pair of vertically spaced-apart brackets, each having an L-shaped cross section defining a horizontal leg and a vertical leg, said vertical legs secured to said side face of said post, said horizontal leg extending from said post and aligning with frame members of a partition panel for securing said post thereto.

* * * * *